US005566557A

United States Patent [19]

Pasquetti

[11] Patent Number: 5,566,557

[45] Date of Patent: Oct. 22, 1996

[54] FINGER RING COMPRISED OF SEVERAL ANNULI

[75] Inventor: Ornella Pasquetti, Milan, Italy

[73] Assignee: Piaget International S.A., Geneva, Switzerland

[21] Appl. No.: 449,708

[22] Filed: May 24, 1995

[30] Foreign Application Priority Data

May 25, 1994 [CH] Switzerland ..... 1616/94

[51] Int. Cl.[6] ..... A44C 9/00

[52] U.S. Cl. ..... 63/15.2; 63/15.1

[58] Field of Search ..... 63/15.1, 15.2, 63/15.3

[56] References Cited

U.S. PATENT DOCUMENTS

| | | | |
|---|---|---|---|
| 479,713 | 7/1892 | Leslie | 63/15.1 X |
| 1,186,271 | 6/1916 | Block | 63/15.2 |
| 1,536,540 | 5/1925 | Thomas | 63/15.3 |
| 1,982,864 | 12/1934 | Granat | 63/15.3 |
| 2,522,954 | 9/1950 | Manne | 63/15.2 |
| 2,726,520 | 12/1955 | Debler | 63/15.3 |

FOREIGN PATENT DOCUMENTS 7422626.9 7/1974 Germany .

*Primary Examiner*—Blair Johnson
*Assistant Examiner*—Andrea Chop
*Attorney, Agent, or Firm*—Young & Thompson

[57] ABSTRACT

A finger ring comprised of several annuli (1, 2, 3) fastened together by a coupling device including a hook (5) extending from a lateral face of a first annulus (2, 3) and designed for entering into a second annulus (1) via an opening (6) provided in one of its lateral faces (8) and for cooperating with a coupling (14) of this second annulus (1).

4 Claims, 1 Drawing Sheet

FINGER RING COMPRISED OF SEVERAL ANNULI

FIELD OF THE INVENTION

The present invention is concerned with a finger ring comprised of two or more annuli.

BACKGROUND OF THE INVENTION

Gold annuli are known which can carry diamonds or other gems, such as in particular wedding rings. It is nowadays common to wear simultaneously two or more such annuli. Such devices make it possible to modify to a certain extent a jewel in the course of time, since a first ring can be given as a gift, then a second one and so further, on special occasions such as anniversaries and other special celebrations.

The drawback of these multiple independent annuli is that their respective rotational position cannot be defined and hence it is imperative that they remain strictly symmetrical in their shape and decoration, since otherwise, the esthetic effect which is sought, would not be obtained. The present invention is aimed at providing a ring comprised of several annuli, which tends to obviate the above-mentioned drawbacks.

BRIEF DESCRIPTION OF THE DRAWINGS

The annexed drawing illustrates schematically and by way of example an embodiment of the ring made of several annuli according to the invention.

DETAILED DESCRIPTION OF THE INVENTION

Figure 1:
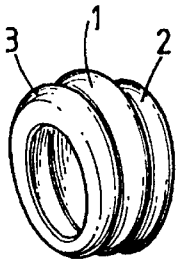
FIG. 1 is a perspective view thereof.
Figure 2:
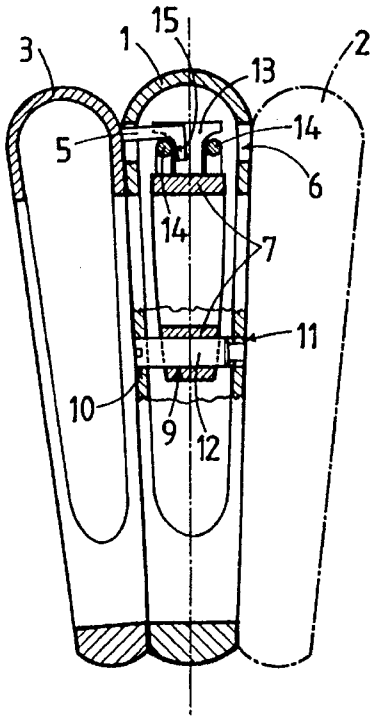
FIG. 2 is an enlarged cross-sectional view of the ring illustrated in FIG. 1.
Figure 3:
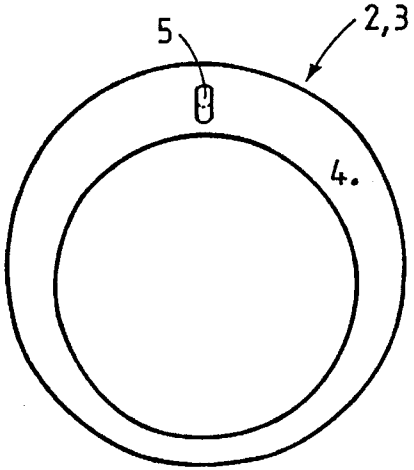
FIG. 3 is a front view of the inner face of one of the outer annuli of the ring.
Figure 4:
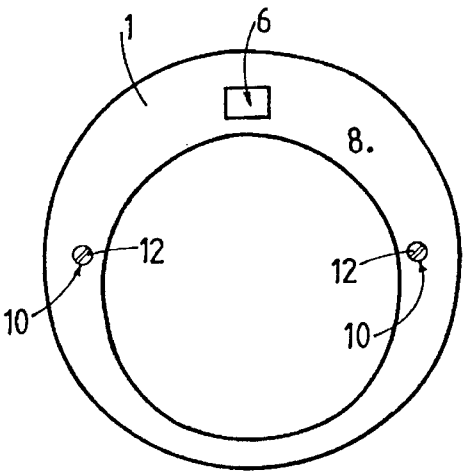
FIG. 4 is a view of one of the lateral faces of the middle annulus of the ring.
Figure 5:
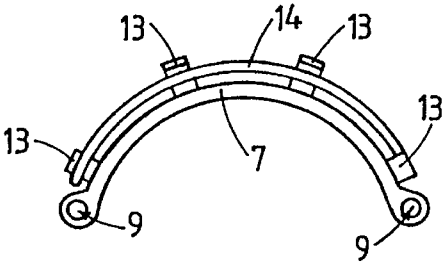
FIG. 5 is a view of the insert housed inside the middle annulus and acting to hold together the annuli.

The finger ring consisting of several annuli as illustrated, includes a central annulus 1 and two lateral annuli 2, 3.

In the example illustrated, each one of the annuli 1, 2 and 3 has two lateral faces contained in planes forming an angle between them and they are connected by a peripheral rounded portion. Each annulus 1–3 is hollow and is provided with a central opening for slipping the ring on the finger of the user.

Clearly, the external surfaces of the annuli, i.e. both their lateral faces and their peripheral surface can be decorated or carry gems.

This ring is provided with coupling means for holding the three annuli 1–3 together in their operative position. Also, a simple relative rotation of 90° of the annuli, makes it possible to separate these annuli from each other.

These coupling means which make it possible to connect temporarily the annuli 1–3 together, include male members integral with the lateral annuli 2, 3 and female members forming part of the central annulus 1.

Each lateral annulus 2, 3 includes on it internal lateral face 4, in the upper part of this face 4, and preferably on the axis of symmetry of the annulus, a hook 5 providing the male coupling member.

The central annulus 1 has on each one of its lateral faces, in their upper portion and aligned with the axis of symmetry of the annulus 1, an opening 6 of a sufficient size for allowing the passage of the hook 5 of the lateral annuli 2, 3.

This central annulus 1 is provided with an insert 7 which is housed in the upper part of annulus 1 between its lateral faces 8 and its upper peripheral portion, in such a manner as to be entirely hidden and invisible. This insert 7 is provided at its ends with bores 9 and has the general shape of an arc of a circle. When the insert 7 is in its operative position in the central annulus 1, the bores 9 face a bore 10 of one of the lateral faces of the central annulus and a threaded bore 11 of the other lateral face of this annulus. Thus, this insert 7 can be fastened in the central annulus 1, by means of two screws 12.

The upper or convex part of insert 7 includes pairs of supports 13 holding in their operative position the spring wires 14, which provide the coupling member of the central annulus cooperating with the hooks 5 for fastening together the annuli 1–3.

The end of each hook 5 carries a nose provided with an oblique ramp 15, designed for coming in contact with one of the wire springs 14.

In order to couple the two annuli, one moves angularly the annuli 1 and 2 or 3 relatively to each other over about 90° while maintaining their lateral adjoining faces parallel to each other. In this rotationally offset position, the nose of the hook 5 of annulus 2 or 3 is introduced through the opening 6 of annulus 1, to hold the annuli together.

Finally the annuli 1 and 2 or 3 are moved angularly one with respect to the other in such a manner that their central openings be aligned for the passage of the finger of the user. By doing this, the ramp 15 of the nose of the hook 5 comes in contact with the wire spring 14 and deforms slightly the wire spring 14, which creates progressively a stress which makes it possible to apply the two annuli one against the other with a sufficient force to maintain them in a predetermined operative angular position.

One thus obtains a coupling with a progressively increasing force and with a resiliently smooth hooking which is perfectly suitable. Once the annuli are in their coupled position and the ring slipped on the finger, the ring has the appearance of a monolithic ring, the annuli being fastened together and being unable to move with respect to each other. Thus, depending on the decoration of the annuli, one can make them to fit together in such a manner as to obtain a ring of a generally harmonious appearance.

This ring can however be disassembled and the annuli can be readily separated. It is thus possible by using a set of 4, 5 or more different annuli to assemble 2 or 3 of them to obtain rings of differing appearance.

It is clear that in one version, one can envisage a ring comprised of two annuli only, one carrying a hook 5 and the other an opening 6 and an insert 7.

For a ring including more than three annuli, there is provided an intermediate annulus carrying a hook 5 on one of its lateral faces and an opening 6 on its other lateral face. This intermediate annulus includes an insert 7 provided with a single wire spring 14. One can thus assemble together any number of annuli for forming a ring.

A ring made of two annuli only can also be made using a lateral annulus 2 or 3 such as illustrated and a second annulus including a simple insert with a single wire 14 and a single opening 6. Such a ring is then adaptable, in that between these two annuli of the ring, it is possible to insert as many intermediate annuli as desired, these annuli being provided with a hook 5 on one face and with an opening 6 on the other and including a simple insert with a single wire 14.

I claim:

1. A finger ring comprised of at least two annuli fastened together removably by means of a coupling device including a male coupling member in the form of a hook extending from a lateral face of at least one first annulus and designed for entering a second annulus via a bore provided on at least one of its lateral faces, the coupling device further including an insert fastened inside the second annulus, said insert comprising at least one wire spring adapted releasably to retain in the coupling position of the annuli a nose of the hook of the first annulus.

2. A ring according to claim 1, wherein the insert is an arcuately shaped part, fastened by its ends to said second annulus, and of which the convex face is provided with supports onto which is fastened the wire spring.

3. A ring according to claim 1, wherein the second annulus is provided with a bore on each one of its lateral faces and wherein the second annulus includes said insert provided with two of said wire springs, this second annulus thus providing a central annulus coupled to two first annuli situated one on each side of the central annulus.

4. A ring according to claim 1, which further includes an intermediate annulus carrying on one of its lateral faces a hook and on the other one of its lateral faces an opening, this intermediate annulus being provided with a said insert designed for cooperating with the hook of said first annulus.

* * * * *